US005601252A

United States Patent [19]

Draghetti

[11] Patent Number: 5,601,252

[45] Date of Patent: Feb. 11, 1997

[54] DEVICE FOR FEEDING REELS TO A USER MACHINE

[75] Inventor: Fiorenzo Draghetti, Villafontana Di Medicina, Italy

[73] Assignee: G.D. S.p.A., Bologna, Italy

[21] Appl. No.: 370,079

[22] Filed: Jan. 9, 1995

[30] Foreign Application Priority Data

Jan. 20, 1994 [IT] Italy ..... BO94A0015

[51] Int. Cl.[6] ..... B65H 19/12

[52] U.S. Cl. ..... 242/559.1; 242/559.3; 242/559.4; 414/911

[58] Field of Search ..... 242/559.1, 559.3, 242/559.4, 559, 560.1; 414/796.4, 796.7, 796.9, 911

[56] References Cited

U.S. PATENT DOCUMENTS

| | | | |
|---|---|---|---|
| 4,589,811 | 5/1986 | Riccardo et al. | 242/559.1 |
| 4,744,711 | 5/1988 | Heitmann et al. | 414/911 |
| 4,863,112 | 9/1989 | Summerauer | 242/559 |
| 4,953,805 | 9/1990 | Rauh | 242/559.1 |
| 4,955,782 | 9/1990 | D'agnolo | 414/911 |
| 5,219,127 | 6/1993 | Boldrini et al. | 242/559.1 |
| 5,226,778 | 7/1993 | Sekitani | 414/911 |
| 5,249,757 | 10/1993 | Draghetti et al. | 242/559.1 |
| 5,437,530 | 8/1995 | Beckmann | 414/911 |

FOREIGN PATENT DOCUMENTS

| | | |
|---|---|---|
| 0144009 | 6/1985 | European Pat. Off. . |
| 2548948 | 1/1985 | France . |
| 9017476 | 4/1992 | Germany . |
| 627955 | 2/1982 | Switzerland . |
| 2167047 | 5/1986 | United Kingdom . |
| 2267280 | 12/1993 | United Kingdom . |

*Primary Examiner*—John M. Jillions
*Attorney, Agent, or Firm*—Guido Modiano; Albert Josif

[57] ABSTRACT

Reels are fed in succession to a user machine by means of a feeder device which has at least one replaceable cartridge-type magazine, in which a stem that extends from a support suitable to be placed in a specific reference position with respect to the user machine slidingly engages a plurality of reels that can be removed in succession from the stem by means of a transfer unit which is interposed between the cartridge magazine and the user machine.

13 Claims, 2 Drawing Sheets

DEVICE FOR FEEDING REELS TO A USER MACHINE

BACKGROUND OF THE INVENTION

The present invention relates to a device for feeding reels to a user machine.

In general, in equipment that comprises machines, such as for example wrapping machines, which use material in tape form, this material is fed to the user machines in the form of reels which are loaded on said machines either manually or by means of a robot or by means of an automatic magazine which is loaded manually or by means of a robot.

In general, use of a robot or of an operator to load a user machine or an automatic magazine is required because when the reels are moved close to the machine or to the associated automatic store they do not occupy a specific position but must be located before being transferred.

SUMMARY OF THE INVENTION

The aim of the present invention is to provide a device for feeding reels which allows to avoid both manual loading and the use of a loading robot.

According to the present invention, a device for feeding reels to a user machine is provided and is characterized in that it comprises, in combination, at least one replaceable cartridge-type reel magazine which in turn comprises supporting and guiding means for a plurality of reels arranged coaxially to each other; transfer means which are meant to transfer the reels to the user machine and comprises centering means for placing the cartridge magazine in a specific reference position with respect to the user machine; and extraction means that are suitable to disengage in succession the reels from said supporting and guiding means and to feed said reels to the user machine.

According to a preferred embodiment of the present invention, said transfer means furthermore comprise movement means for moving said reels along said supporting and guiding means until said reels occupy, in succession, a position for engaging said extraction means.

BRIEF DESCRIPTION OF THE DRAWINGS

The present invention is now described with reference to the accompanying drawings, which illustrate a non-limitative example of embodiment thereof, wherein.

DESCRIPTION OF THE PREFERRED EMBODIMENTS

Figure 1:
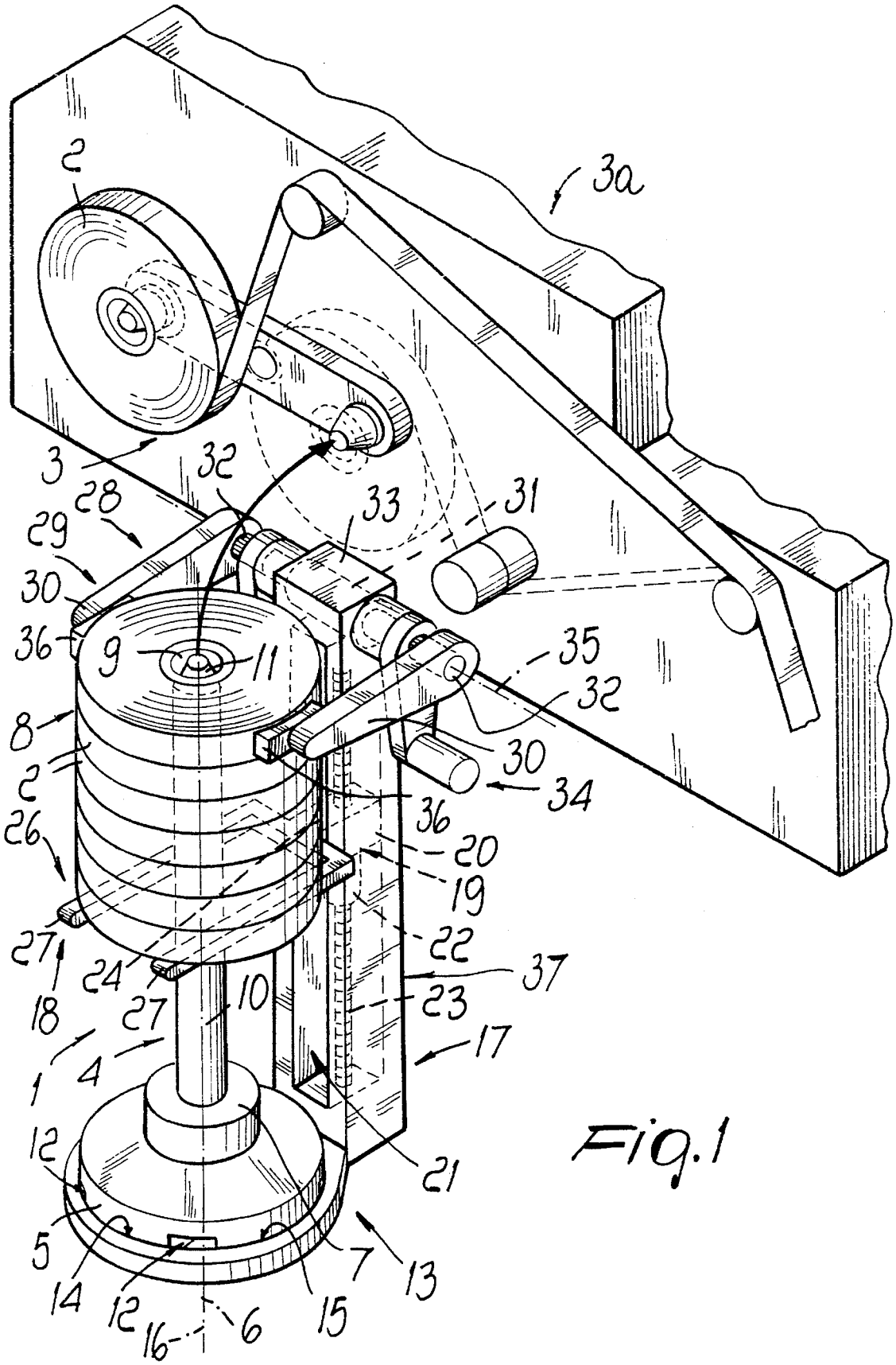
FIG. 1 is a schematic perspective view of a preferred embodiment of the feeder according to the present invention.

With reference to FIG. 1, the reference numeral 1 generally designates a feeder for reels 2 which is suitable to feed said reels 2 to a known type of reel supporting device 3 of a user machine 3*a*.

Figure 2:
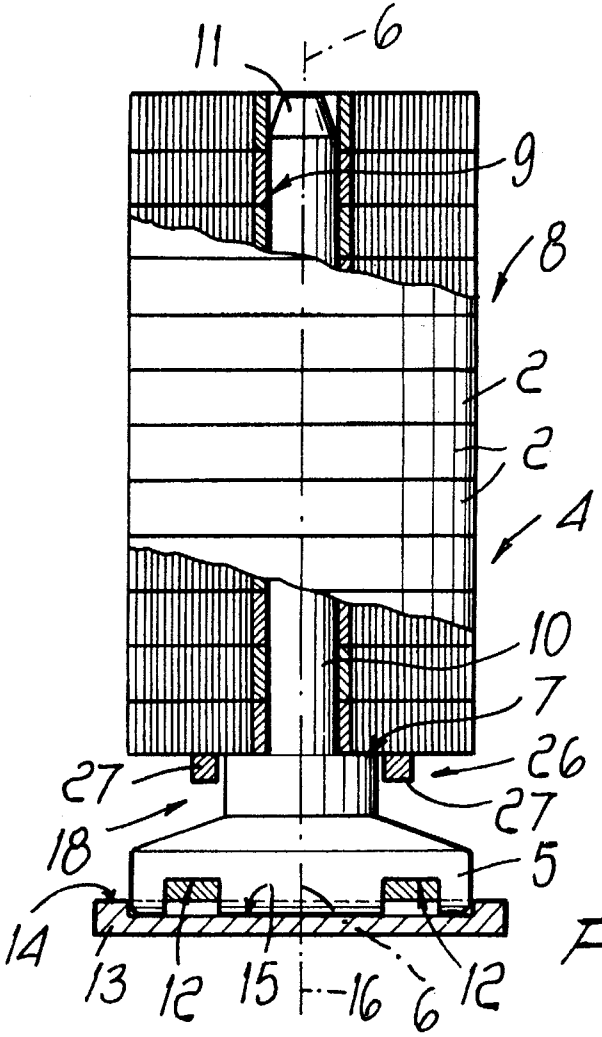
FIG. 2 is an axial sectional view of a detail of FIG. 1.

The feeder 1 comprises a cartridge-like magazine 4 which in turn comprises, as more clearly shown in FIG. 2, a circular base 5 that has a vertical axis 6 and is limited at the top by a flat surface 7 that lies at right angles to the axis 6 and is meant to support a stack 8 of reels 2 which are coaxial to the axis 6 and have respective central holes 9 which are engaged by a sliding and guiding stem 10 which has a substantially circular cross-section and is rigidly coupled to the base 5. The stem 10 is also coaxial to the axis 6 and is limited, at the end that lies opposite to the one connected to the base 5, by a frustum-shaped end portion 11.

The base 5 has a lower resting surface on which two horizontal and mutually parallel slots 12 are formed; each slot is suitable to be engaged by a corresponding arm of a handling fork 12*a* (FIG. 3) which is suitable to place the magazine 4 on a footing 13 which is part of the device 1.

The footing 13 is located adjacent to the reel supporting device 3 and is limited, at the top, by a flat and substantially horizontal surface 14 in which a cylindrical seat 15 is formed; said seat 15 is coaxial to a vertical axis 16. The inside diameter of the seat 15 is slightly larger than the outside diameter of the base 5 and is suitable to accommodate said base 5 so that the axes 6 and 16 are coaxial to each other and so as to place the magazine 4 in a precise reference position with respect to the machine 3*a*.

A post 17 rises from the footing 13, is parallel to the axis 16, and is arranged adjacent to the peripheral region of the seat 15. Said post 17 internally accommodates movement means consisting of a lifting device 18 which comprises a reversible motor 19 with a hollow shaft; an external casing 20 of said motor is slideably mounted, with a side-fitting engagement, within a slot 21 which is formed along said post 17 and is directed towards the axis 16 of the seat 15. The motor 19 is suitable to rotate a female thread 22 which lies inside the slot 21 parallel to the axis 16 and is engaged by a fixed screw 23 that runs along the entire length of the post 17. The casing 20 has, on the side directed towards the axis 16, a tab 24 which protrudes from the slot 21 transversely to said slot 21; a fork 26 is connected to the free end of said tab, lies above the footing 13 in a direction that is substantially transverse with respect to the axis 16, and comprises two arms 27 suitable to raise the stack 8 vertically along the stem 10 so as to always place a reel 2 at the end portion 11 of said stem 10.

According to what is shown in FIG. 1, the post 17 has, at its free end, an extraction device 28 which is suitable to disengage in succession the reels 2 that are located at the top of the stack 8, and therefore at the end portion 11 of the stem 10, and to feed said reels 2 to the reel supporting device 3. The device 28 comprises a fork 29 with two arms 30 which are mutually connected by a double cylinder 31 which forms, together with the two corresponding extension rods 32, a cross-member which is rotatably mounted through a support 33 that is rigidly coupled to the post 17. A respective arm 30 is keyed to the free end of each rod 32, and each rod is coupled to a respective actuation device 34 (only one of which is shown in FIG. 1) in order to rotate about an axis 35 which lies transversely to the axis 16. Each arm 30 supports, at its free end, a respective pad 36 which has a circular internal profile suitable to make contact with the outer surface of the reel 2 in a position that is diametrically opposite to the position of the other pad 36 when the two arms 30 are in an engagement position that lies transversely to the axis 16.

By virtue of the actuation of the cylinder 31 it is possible to vary the distance between the arms 30 from a spaced position to a closer position, in which the distance between the two pads 36 is equal to the diameter of the reels 2. By virtue of the actuation of the actuation devices 34 it is possible to move the arms 30 between the above mentioned grip position and a release position, in which said arms 30 are arranged in a substantially vertical position and a reel 2 clamped between the arms 30 is coupled to a pivot of the reel supporting device 3.

Figure 3:
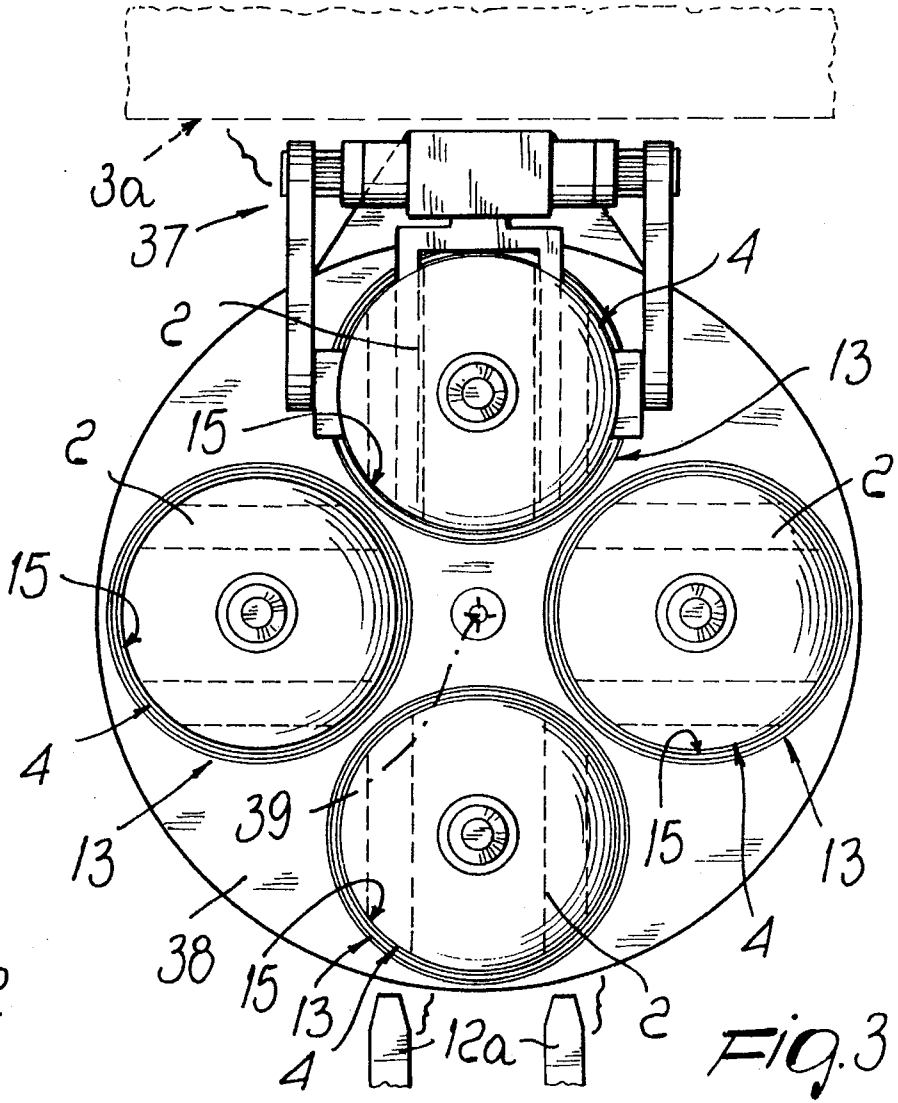
FIG. 3 is a schematic perspective view of a variation of the feeder of FIG. 1.

The post 17, the lifting device 18, and the extraction device 28 form a transfer unit 37 which, according to the embodiment shown in FIG. 3, is associated with an indexed platform 38 instead of with a fixed footing 13; said platform is suitable to rotate stepwise about its own vertical axis 39 under the thrust of a known actuation device which is not shown. The platform 38 has multiple peripheral seats 15, and each seat accommodates a respective magazine 4; the seats are made to advance stepwise along a circular path that passes in front of the unit 37 so as to stop in succession in front of said unit 37 and allow to unload the corresponding reels 2.

The operation of the transfer unit 37, both in the configuration in which it is associated with the fixed footing 13, and in the configuration in which it is associated with the platform 38, can be immediately deduced from the above description and requires no further explanation. However, it should be specified that first of all the use of the magazines 4 allows to prepare the stacks 8 away from the machine 3*a* and to handle said stacks 8 by means of forks; and that secondly the presence of the seat or seats 15 allows to arrange each stem 10 in a substantially specific and precise position with respect to the reel supporting device 3. Accordingly, not only is the manual work related to the feeding of the reels 2 to the machine 3*a* reduced drastically, but also there is no further need to use a robot, since the position of the axis of the reels 2 and therefore the position of said reels 2 is perfectly defined.

What is claimed is:

1. Device for feeding reels to a user machine, said device comprising in combination:

at least one replaceable cartridge-type magazine for reels, said magazine having supporting and guiding means for a plurality of reels, said supporting and guiding means extending along an axis thereof and said reels being arrangeable on said supporting and guiding means coaxially to each other and to said axis; and transfer means for transferring said reels to the user machine, wherein said transfer means comprises: centering means for positioning said cartridge magazine in a specific reference position with respect to the user machine; extraction means for disengaging in succession the reels from said supporting and guiding means and for feeding said reels to the user machine; movement means for moving said reels along said supporting and guiding means until said reels occupy, in succession, a position in which they are engageable by said extraction means; and said cartridge magazine comprises a base, said base being removably coupled to said centering means, said supporting and guiding means comprising a stem that extends from a side face of said base along said axis, said stem being rigidly coupled to said base, whereby said stem is adapted to engage the reels of a stack of mutually coaxial reels.

2. Device according to claim 1, wherein said base has, on a further side face that lies opposite to said face that supports said stem, slots, said slots being engageable by a handling fork.

3. Device according to claim 1, wherein said centering means comprises at least one seat, said seat partially accommodating a respective said base to locate said axis of a corresponding said stem in a specific reference position.

4. Device according to claim 3, wherein the axis of said stem is a substantially vertical axis; said movement means comprising a lifting means for lifting the reels along said stem.

5. Device according to claim 3, further comprising a fixed footing, said footing supporting said seat.

6. Device according to claim 3, further comprising an indexed platform, said platform being rotatable about an axis thereof, several of said seats being uniformly distributed around said axis on said platform.

7. Device for feeding reels to a user machine, said device comprising in combination:

at least one replaceable cartridge-type magazine for reels, said magazine having supporting and guiding means for a plurality of reels, said supporting and guiding means extending along an axis thereof and said reels being arrangeable on said supporting and guiding means coaxially to each other and to said axis; and transfer means for transferring said reels to the user machine, wherein said transfer means comprises: centering means for positioning said cartridge magazine in a specific reference position with respect to the user machine; extraction means for disengaging in succession the reels from said supporting and guiding means and for feeding said reels to the user machine; movement means for moving said reels along said supporting and guiding means until said reels occupy, in succession, a position in which they are engageable by said extraction means, said movement means comprising a lifting means for lifting said reels along said axis to said position in which they are engageable by said extraction means, said centering means comprising at least one seat defining an axis thereof and being located adjacent to said user machine, said cartridge magazine being positioned in said specific reference position with the supporting and guiding means thereof being coaxial with said seat.

8. Device according to claim 7, wherein said cartridge magazine comprises a base, said base being removably coupled to said centering means; said supporting and guiding means comprising a stem that extends from a side face of said base along said axis, said stem being rigidly coupled to said base, whereby said stem is adapted to engage the reels of a stack of mutually coaxial reels.

9. Device according to claim 8, wherein said base has, on a further side face that lies opposite to said face that supports said stem, slots, said slots being engageable by a handling fork.

10. Device according to claim 8, wherein said at least one seat partially accommodates a respective said base to locate said axis of a corresponding said stem in a specific reference position.

11. Device according to claim 8, wherein the axis of said stem is a substantially vertical axis; said lifting means comprising two arms for raising said plurality of reels along said stem.

12. Device according to claim 10, further comprising a fixed footing, said footing supporting said seat.

13. Device according to claim 10, further comprising an indexed platform, said platform being rotatable about an axis thereof, several of said seats being uniformly distributed around said axis on said platform.

* * * * *